US011808003B2

(12) United States Patent
Huston et al.

(10) Patent No.: US 11,808,003 B2
(45) Date of Patent: Nov. 7, 2023

(54) METHOD OF REHABILITATING A MANHOLE

(71) Applicant: HYDRO-KLEAN, LLC, Des Moines, IA (US)

(72) Inventors: Matthew T. Huston, Rhinelander, WI (US); Michael Ingham, Overland Park, KS (US)

(73) Assignee: HYDRO-KLEAN, LLC, Des Moines, IA (US)

( * ) Notice: Subject to any disclaimer, the term of this patent is extended or adjusted under 35 U.S.C. 154(b) by 473 days.

(21) Appl. No.: 17/248,635

(22) Filed: Feb. 1, 2021

(65) Prior Publication Data

US 2022/0243420 A1 Aug. 4, 2022

(51) Int. Cl.
*E02D 29/12* (2006.01)

(52) U.S. Cl.
CPC ..... *E02D 29/128* (2013.01)

(58) Field of Classification Search
CPC ..... E02D 29/128; F16L 55/163; E03F 2003/065; E03F 5/02
See application file for complete search history.

(56) References Cited

U.S. PATENT DOCUMENTS 1,712,510 A * 5/1929 Monie ..... E02D 29/12 182/90
2,816,323 A * 12/1957 Munger ..... B28B 21/94 138/146
4,670,315 A * 6/1987 Hillemeier ..... E02D 31/06 427/403
5,002,438 A * 3/1991 Strong ..... E02D 29/128 405/133
5,017,313 A * 5/1991 Trimble ..... E02D 29/124 264/269
5,081,802 A * 1/1992 Westhoff ..... E02D 29/149 404/26
5,303,518 A * 4/1994 Strickland ..... B28B 19/0046 52/249
5,383,311 A 1/1995 Strickland
5,465,758 A * 11/1995 Graf ..... F16L 55/163 405/150.1

(Continued)

OTHER PUBLICATIONS

Manhole Rehabilitation Services, "Manhole Rehab, Repairs and Structure Rehabilitation", HK Solutions, https://www.hksolutionsgroup.com 2021.

(Continued)

*Primary Examiner* — Gisele D Ford
(74) *Attorney, Agent, or Firm* — McKee, Voorhees & Sease, PLC

(57) ABSTRACT

The method of repairing a manhole begins with assembling concrete forms above ground to correspond to the shape of the manhole wall. Then, a plastic liner sheet is wrapped around the assembled forms and the seams are welded. The forming sections are then removed, and the liner is placed in the manhole. An annular space exists between the liner and the manhole wall. The forming sections are re-assembled inside the liner. Concrete is then poured into the annular space and allowed to cure. The forming sections are removed, leaving the liner anchored in a new monolithic concrete wall fully engaging the old manhole wall.

20 Claims, 6 Drawing Sheets

(56) References Cited

U.S. PATENT DOCUMENTS 5,490,744 A * 2/1996 McNeil ..... E02D 29/125 405/133
5,499,660 A * 3/1996 StorgArd ..... F16L 55/1657 264/269
5,580,406 A 12/1996 O'ffill
5,608,998 A * 3/1997 Hume ..... E02D 29/12 52/592.1
5,769,459 A * 6/1998 Graf ..... F16L 55/163 285/15
5,868,434 A * 2/1999 Brakland ..... F16L 55/163 285/15
6,018,914 A * 2/2000 Kamiyama ..... E03F 5/02 52/182
6,634,828 B1 * 10/2003 Hovad ..... B29C 63/28 264/269
8,720,907 B2 * 5/2014 Worley ..... F16L 21/08 24/282
9,011,035 B2 * 4/2015 Munro ..... E02D 29/1409 404/26
9,562,339 B2 2/2017 Kiest, Jr.
10,442,617 B1 * 10/2019 Holbrook ..... B65D 21/0234
10,458,093 B2 * 10/2019 Gilbert ..... E02D 29/14
10,688,713 B1 * 6/2020 White ..... E03F 5/025
10,968,594 B1 * 4/2021 Friesen ..... E02D 29/128
2007/0113519 A1 * 5/2007 Kiest ..... E02D 29/128 52/741.41
2008/0054625 A1 * 3/2008 Kamiyama ..... E03F 3/06 285/15
2008/0193221 A1 * 8/2008 Lee ..... F16L 55/163 405/184.2
2010/0139799 A1 * 6/2010 Kamiyama ..... F16L 55/1651 405/184.2
2012/0009020 A1 * 1/2012 Kiest, Jr. ..... E04B 1/66 405/150.1
2013/0154163 A1 * 6/2013 Kiest, Jr. ..... E02D 29/128 264/494
2014/0261833 A1 * 9/2014 Kiest, Jr. ..... E02D 29/128 138/98
2016/0097180 A1 * 4/2016 Pesonen ..... E02D 29/1409 404/26
2017/0016568 A1 * 1/2017 Kamiyama ..... F16L 55/1657
2020/0332488 A1 * 10/2020 Huston ..... E02D 29/12
2020/0378542 A1 * 12/2020 Eitel ..... F16L 55/163
2021/0131602 A1 * 5/2021 Wenk ..... F16L 55/163

OTHER PUBLICATIONS

SURE-GRIP®, Concrete Protection from AGRU America, https://agruamerica.com/products/sure-grip/, May 13, 2021.
AGRU-ULTRA GRIP®, Concrete Protection from AGRU America, https://agruamerica.com/products/ultra-grip/, May 13, 2021.

* cited by examiner

METHOD OF REHABILITATING A MANHOLE

FIELD OF THE INVENTION

The invention relates to a method of repairing or rehabilitating underground structures, such as a manhole, having deteriorating walls by forming a new interior, monolithic concrete wall having an embedded corrosion-resistant barrier anchored in the new wall.

BACKGROUND OF THE INVENTION

Manholes and other formations provide cavities below the ground level to access sewers, water lines, drains, pipes, electrical wires, cables, and the like. The walls of these structures are often made of brick or concrete and may be subject to very corrosive environments which deteriorate the brick or concrete. Severe deterioration requires the cavity wall to be replaced or repaired. Replacement requires excavation, known as opencut, which is time-consuming and expensive, and may create issues such as community disruption, traffic detours, sewer bypassing, and poor soil compaction following excavation backfilling. Repair requires formation of a new manhole wall inside the existing wall, which may be difficult, though less expensive than replacement and without some of the issues.

The Hydro-Klean Monoform system is one option for repairing a damaged manhole. The monoform system is a no-dig or trenchless rehabilitation process for restoring manholes via installation of a new monolithic concrete wall adjacent the old wall. With the Monoform system, restoration is accomplished by installing a custom-forming system within the existing manhole, leaving an annular space to be filled with a high-strength ready-mix concrete. The system includes various diameters to fit most structures, including those having concentric and eccentric cone configurations. The Monoform system eliminates troubles associated with opencut replacement. The finished, rehabilitated manhole has a similar design and life expectancy to that of installing a new, precast manhole, without excavation. However, the new concrete wall formed by the Hydro-Klean system is still subject to the corrosive environment.

Protective coatings may be sprayed on new or old concrete to minimize or reduce deterioration. Another alternative is a plastic liner mounted on or secured to the concrete, such as the Sure-Grip and Ultra-Grip protective sheets manufactured by Agru America. The Agru liners are used for both new construction and rehabilitation of existing concrete structures in prefabricated and preassembled sections. The Agru liners have not been used for monolithic concrete manhole rehabilitation.

Accordingly, a primary objective of the present invention is the provision of a method of rehabilitating a manhole using custom forms and a protective sheet liner.

Another objective of the present invention is a provision of a process for repairing manholes using the Hydro-Klean Monoform system for forming a new concrete manhole wall with an anchored or embedded plastic liner for corrosion protection.

A further objective of the present invention is the rehabilitation or repair of underground cavities with a new concrete wall having a corrosion-resistant barrier integrally formed thereon.

Still another objective of the present invention is the provision of a method of forming a monolithic concrete wall with a protective plastic barrier below grade without excavation to the full manhole depth.

Yet another objective of the present invention is the provision of a method of repairing manholes and similar underground structures that is relatively simple, economical, safe, and durable.

These and other objectives become apparent from the following description of the invention.

SUMMARY OF THE INVENTION

The rehabilitation or repair method for a manhole and other underground walls utilizes a forming system with various sections of which can be assembled so as to correspond to the wall needing repair. The method involves the initial step of assembling sections of a forming system above ground and then applying a plastic liner sheet or barrier on the exterior of the formed sections. The form sections are then removed, leaving the liner in the shape of the assembled forming system. The liner is then collapsed or folded, and moved into the manhole or other underground cavity, and then expanded or unfolded, so as to provide a 3-8 in space between the liner and the wall. The forming system is then reassembled inside the liner to provide structural support of the liner. Concrete is then poured into the space and allowed to cure. After the concrete has cured, at least to a level to avoid slump, the forming sections are removed, leaving the newly formed monolithic concrete wall with the liner sheet or barrier anchored thereto for corrosion protection. The outside seams of the liner are welded above ground, before the forming sections are disassembled, while the inside seams of the liner sheet are welded below ground after the forming system is removed.

DETAILED DESCRIPTION OF THE INVENTION

The method of the invention produces an in-situ, trenchless monolithic concrete structural relining with a corrosion barrier for the rehabilitation of underground utility components, such as a manhole, vaults, and tanks. The integrated thermoplastic liner provides long-term protection to the newly formed concrete layer from corrosive attack and degradation caused by chemically caustic and/or acidic fluids and gases, such as those present in industrial, municipal wastewater sewer systems and other environments. The benefits of high strength and stiffness of concrete, combined with the benefits of flexible, ductile, corrosion resistant thermoplastics produces a durable internal wall. The protective layer, integrated with the concrete, also prevents clear groundwater infiltration and exfiltration or the outward leaking of industrial and/or municipal wastewater contaminants, so as to protect the environment.

Figure 2A:
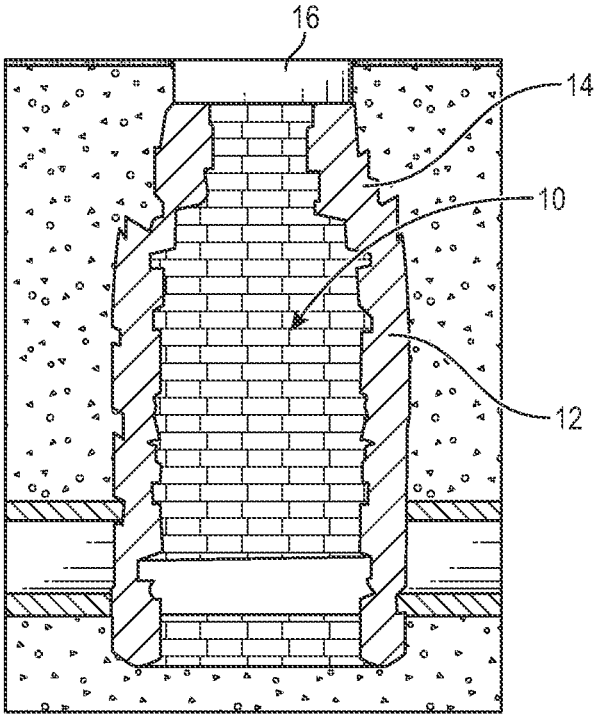
FIG. 2A illustrates a damaged manhole, to be repaired using the method of the present invention.
Figure 2B:
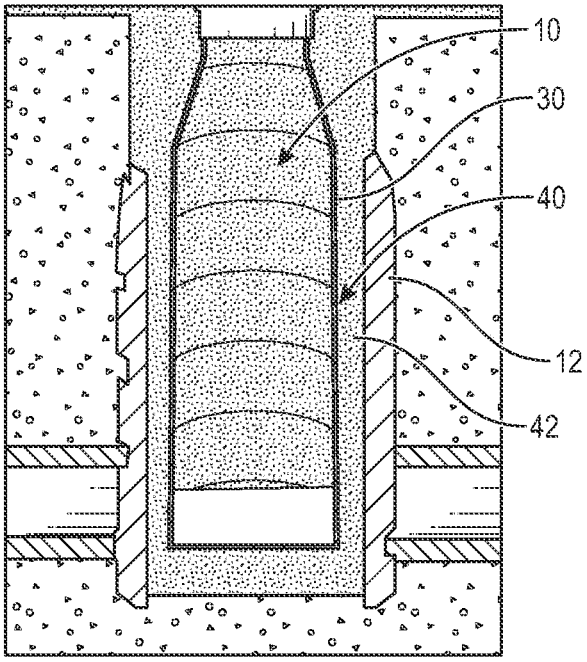
FIG. 2B shows the rehabilitated manhole having the new concrete wall and liner, according to the present invention.

As seen in FIG. 2A, a manhole 10 generally includes a sidewall 12, an upper conical section 14, which may be concentric or eccentric, and a chimney 16, which supports the removable manhole lid (not shown). The sidewall 12 typically is cylindrical, and can be made of brick, block, or poured concrete. Construction of the structural new concrete liner utilizes a custom, cylindrical forming system, such as the Monoform system by Hydro-Klean, that includes plastic or steel panels of varying degrees, diameters, and heights, which may be combined with concentric or eccentric conical or tapered sections to create a reduced-diameter upper end. The forming system is field configurable, thereby allowing the system to be applied in various manhole, tank and vault structures having different dimensions. The customizable forming system is reusable.

Figure 3:
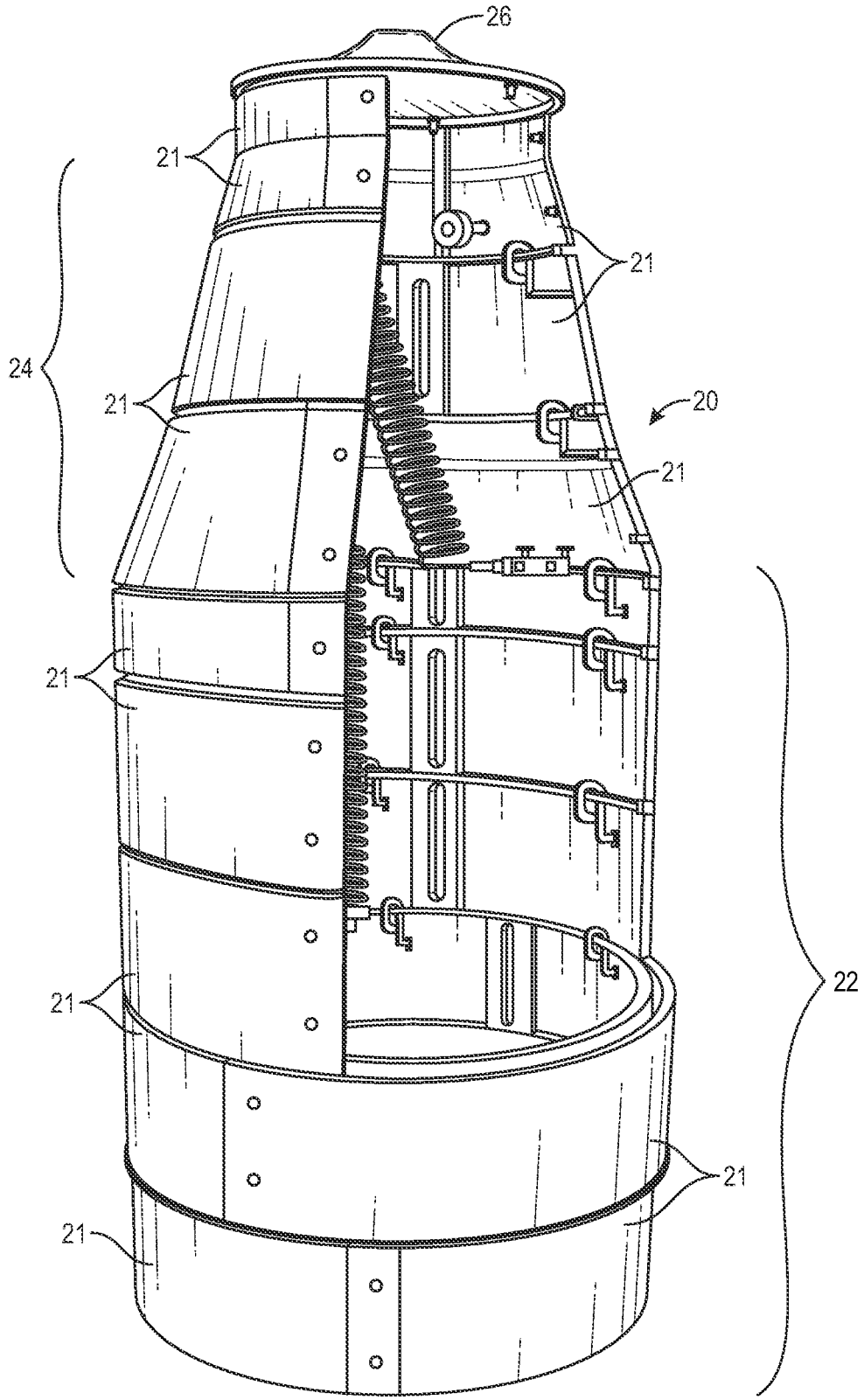
FIG. 3 shows a Hydro-Klean monoform system, with some sections removed for clarity.

FIG. 3 shows a forming system 20 for use in the present invention. The forming system 20 includes a plurality of sections 21 having different sizes and shapes, and which can be joined to form a cylindrical body 22, a concentric or eccentric conical portion 24, and a top hat or lid 26. The cylindrical and conical portions 22, 24 may be formed with multiple layers, each formed by two or more sections, which when connected, and extend 360°. Thus, the height of each of the cylindrical and conical portions 22, 24 can be varied, as needed to match the interior of the manhole, tank or vault being rehabilitated. The forming system may also be constructed to fit non-cylindrical shapes, such as a square or rectangular tank or vault having an internal cavity accessible through an opening in the tank or vault ceiling. Also, the forming system may also include a chimney portion (not shown) on top of the conical portion to match a chimney of the manhole and allowing the cover to be set at any specified elevation.

Figure 4:
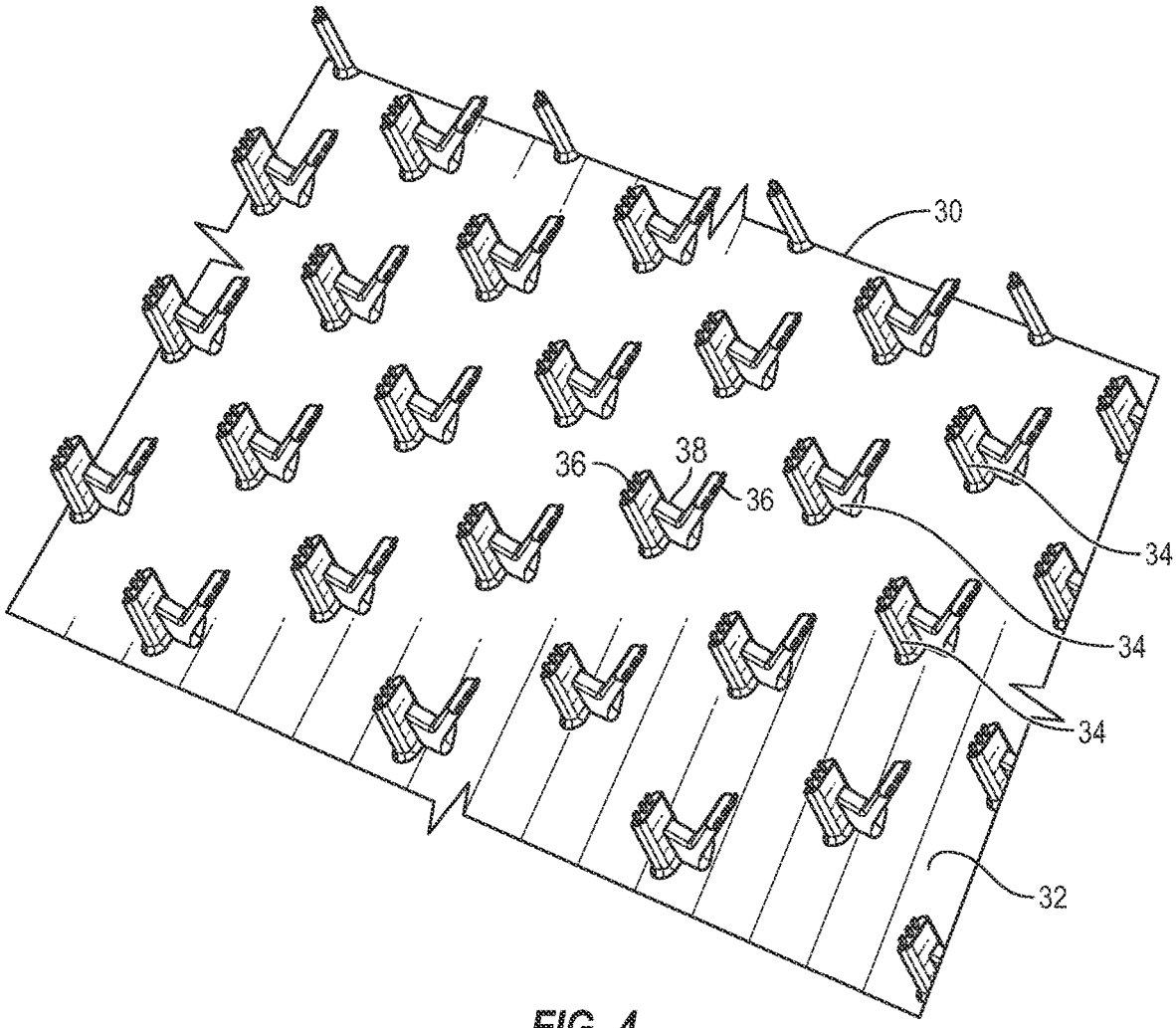
FIG. 4 is a perspective view of a plastic liner sheet having integral V-shaped anchors, to be used with a forming system, in accordance with the present invention.
Figure 5:
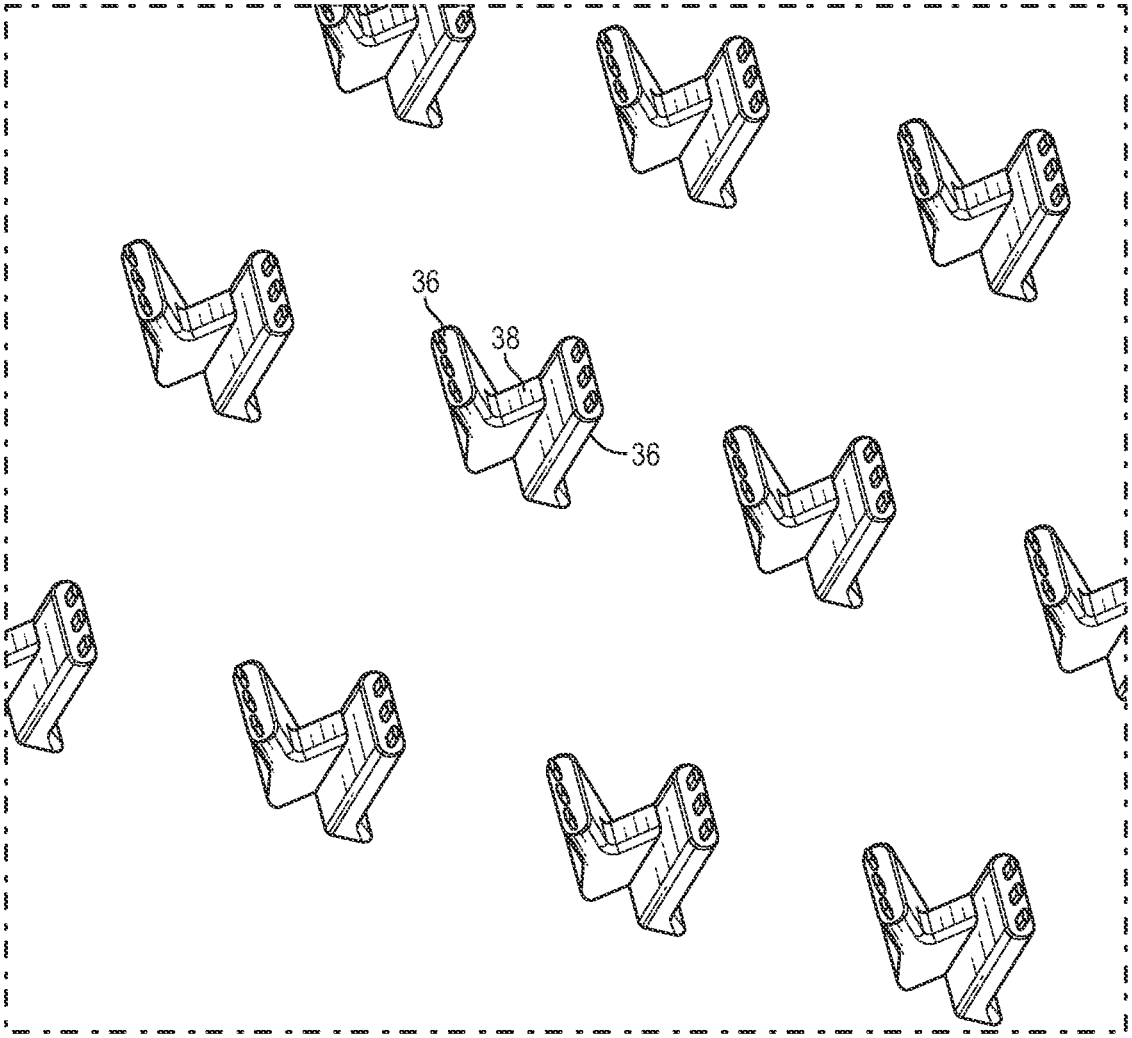
FIG. 5 is an enlarged view showing a preferred embodiment of the liner anchors.
Figure 6C:
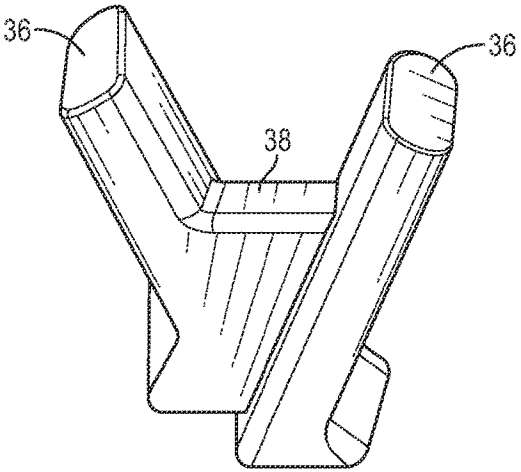
FIGS. 6A, B and C are enlarged views of different embodiments or shapes for the liner anchors.
Figure 6B:
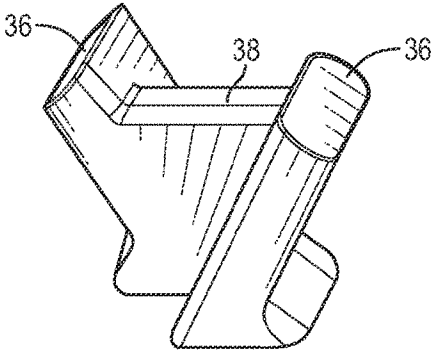
Figure 6A:
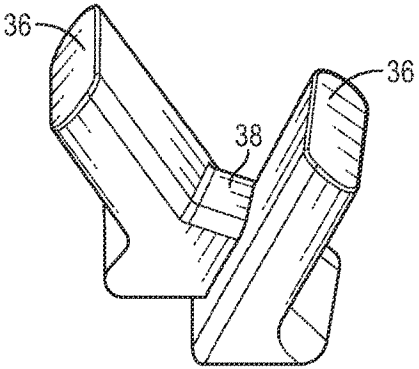
Figure 7:
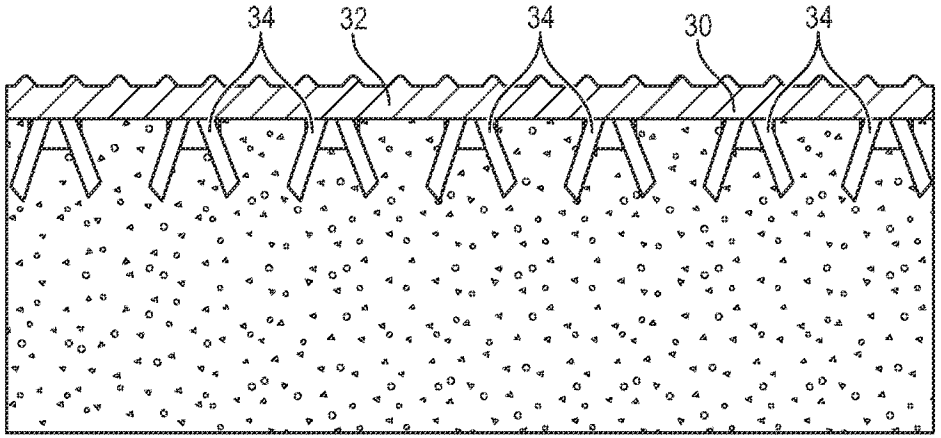
FIG. 7 is a sectional view showing a portion the new concrete with the liner anchored thereto.

The liner 30 of the present invention is shown in FIGS. 4-6. A liner is preferably formed of plastic, such as HDPE, HDPE-el, PP, PVDF, or ECTEE. The liner is manufactured as a flat sheet, with sufficient flexibility to allow the sheet to be wrapped or folded into a curved shape. The liner 30 includes a flexible base 32 having a plurality of anchors 34. As seen in the close-up FIGS. 5 and 6, each anchor 34 preferably has a pair of diverging legs 36 joined by an interconnecting web 38, such that the anchors have a V-shaped profile. As seen in FIG. 6, the web 38 may be short, tall, or intermediate in height. One example of a preferred liner is the Ultra Grip or Sure Grip, manufactured by AGRU America in South Carolina. Other liners having anchors may also be used without departing from the scope of the present invention.

Figure 1:
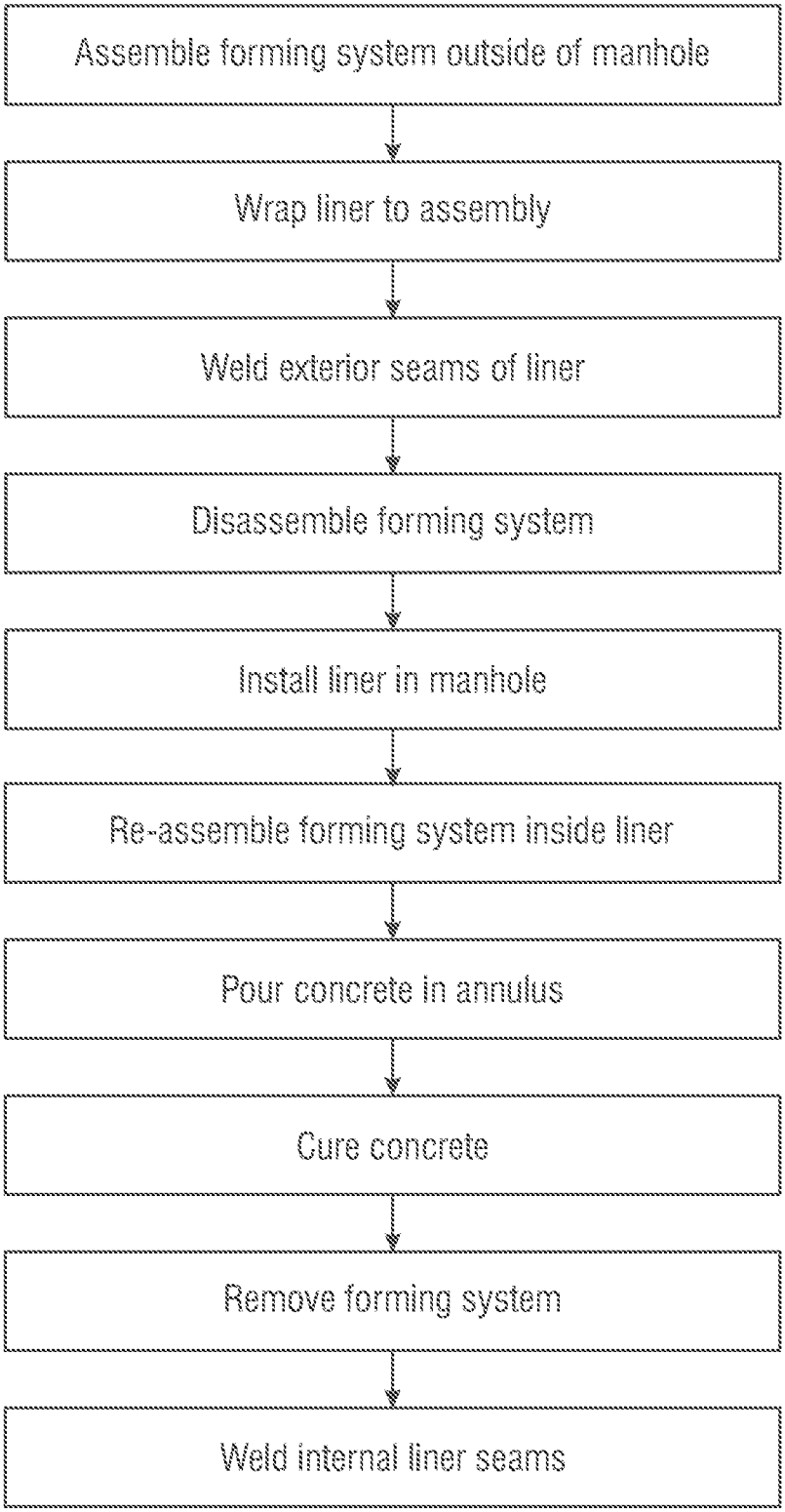
FIG. 1 is a flow chart for the manhole rehabilitation process according to the present invention.

The process for rehabilitating a manhole or similar structure is illustrated in the flow chart of FIG. 1. First, the dimensions of the structure to be rehabilitated are determined. To properly prepare the existing manhole for the new concrete wall liner, the existing chimney and surrounding soil material is removed to a rough opening of 36". From that point and below, the old structure is used as an outside form. From the 36" rough opening and above, a 36" pour tube is used as the outside form.

This form remains in place following construction. A removable form is also acceptable. The reason to remove the chimney is to allow the new liner wall to be constructed at a specified thicknesses without reducing access diameter into the structure after the wall and liner is constructed in place, as described in the following steps.

The form sections 21 to form the cylindrical and conical portions 22, 24 of the forming system 20 are gathered and assembled above ground, apart from the manhole. After the forming system 20 is assembled, one or more sheets of the liner 30 are wrapped around the cylindrical body 22 and the conical portion 24 of the system 20, (and the chimney portion, if present or required), and the exposed outside vertical seams, which preferably overlap, are welded to secure the shape of the liner sheet. The liner sheets are not attached to the forming sections 21. Then, the forming system sections 21 are disassembled and removed from inside the liner 30, leaving the formed liner with a cylindrical body and conical upper portion (as well as a chimney portion, if needed). This formed liner body is flexible and can be partially collapsed so as to fit through the open top of the manhole 10 and set upon the floor of the manhole so as to be spaced from the sidewall 12 of the manhole 10. This installation of the formed liner body into the manhole and expansion of the liner body to it full diameter creates an annular space 40 between the liner body and the sidewall 12, with the anchors 34 residing within the annular space 40. Preferably, the annulus space 40 has a radial depth of approximately 3-8".

Next, the forming system sections 21 are re-assembled inside the liner 30 in the manhole, so that the sections engage the interior of the liner to provide radial support to the liner 30. Then, the pouring hat or lid 26 is secured to the top of the forming system 20 so as to close the interior of the system 20. Then, concrete is poured into the annular space or annulus 40 so as to fill the space from bottom to top to create the new inner concrete wall 42. After the concrete has cured at least sufficiently to preclude slumping, the forming system sections 21 are removed, leaving the new monolithic concrete wall 42 with the liner 30 integrally secured thereto by the anchors 34. Then, the inside vertical and radial seams of the liner 30 are welded, thereby completing the rehabilitation process.

The method described for a manhole rehabilitation can also be used on other underground walls having other shapes, such as tanks or vaults, so as to repair such structures with a new interior wall having an integral anchored protective barrier.

The anchoring system provides a secure, mechanical bond of the liner 30 to the concrete wall 42, even though plastic and concrete have different thermal expansion coefficients. The liner anchoring system also allows for use in areas of high groundwater back pressure. Also, the thickness of the liner base 32 may be increased or decreased, depending on the specific project requirements and local conditions. The height of the anchors 34 may also be increased or decreased, depending on the factors present for each application, such as the hydrostatic pressure. Depending on project requirements, the welding technologies may include butt welding, extrusion welding, and/or hot wedge welding, to provide secure and leak-proof joints and seams in the liner 30.

The embodiment described hereinbefore is merely preferred embodiment of the present invention and not for purposes of any restrictions or limitations on the invention. It will be apparent that any non-substantive, obvious alterations or improvement by the technician of this technical field according to the present invention may be incorporated into ambit of claims of the present invention.

What is claimed is:

1. A method of rehabilitating a manhole having a wall with a lower cylindrical portion, an upper conical portion, and an upper access opening, comprising:

preassembling a first set of forms into a cylindrical shape outside the manhole;

wrapping a first liner sheet with outwardly projecting anchors around the cylindrically shaped first set of forms;

preassembling a second set of forms into a conical shape on top of the cylindrically shaped first set of forms;

wrapping a second liner sheet with outwardly projecting anchors around the conically shaped second set of forms;

welding outside seams in the first and second liner sheets to create a liner body with cylindrical and conical portions;

removing the first and second forms from the liner body;

positioning the liner body into the manhole to create an annular space between the liner body and the manhole wall; and then re-assembling the first set of forms and the second set of forms inside the liner body;

pouring concrete into the annular space so that the projections of the first and second liner sheets are embedded in the concrete;

allowing the concrete to cure; and removing the forms from the manhole after the concrete has cured at least partially to leave a new concrete wall sandwiched between the manhole wall and the liner body.

2. The method of claim 1 wherein the manhole has a chimney on top of the conical portion, and the method further comprising:

preassembling a chimney form on top of the preassembled second set of forms, wrapping the chimney form with a third liner sheet having outwardly projecting anchors, welding a vertical seam in the third liner sheet so that the third liner sheet becomes a part of the liner body, then removing the chimney form from the third liner sheet, re-assembling the chimney form inside the liner body before pouring the concrete into the annular space, and removing the chimney form from the manhole after the concrete has at least partially cured.

3. The method of claim 1 wherein the anchors are formed in pairs, with the anchors in each pair extending angularly from one another.

4. The method of claim 1 wherein the forms are not connected to the liner body.

5. The method of claim 1 further comprising welding inside seams in the liner body after the forms are removed from the manhole.

6. The method of claim 1 further comprising collapsing the liner body to fit downwardly through the access opening into the manhole.

7. The method of claim 6 further comprising opening the collapsed liner body inside the manhole.

8. The method of claim 1 wherein the forms are reusable for rehabilitation of another manhole.

9. The method of claim 1 wherein the forms are custom fit for the manhole.

10. The method of claim 1 wherein the annular space is approximately 3-8 inches thick.

11. A method of repairing a wall of a cavity below ground level, comprising:

erecting forms above ground level to a shape approximating the cavity shape;

adding a protective barrier around the erected forms, and the barrier having outwardly extending projections;

disassembling the erected forms to leave the protective barrier in a shape matching the erected forms and having interior and exterior sides;

moving the protective barrier to a position inside the cavity and with an annular space between the wall of the cavity and the barrier;

erecting the forms inside the cavity adjacent the interior side of the barrier; pouring concrete in the annular space to form a new concrete wall between the barrier and the cavity wall with the projections embedded in the new concrete wall; and removing the forms from the cavity.

12. The method of claim 11 further comprising welding seams on the exterior side of the barrier before moving the barrier inside the cavity.

13. The method of claim 11 further comprising welding seams on the interior side of the barrier after the forms are removed.

14. The method of claim 11 wherein the forms engage the barrier inside the cavity to provide support to the barrier when the concrete is poured into the annular space.

15. The method of claim 11 wherein the erected forms have a cylindrical lower portion.

16. The method of claim 11 wherein the erected forms have a conical upper portion.

17. The method of claim 11 wherein ground around the cavity wall remains intact during the repair.

18. The method of claim 11 the further comprising covering the forms with a lid before the concrete is poured.

19. The method of claim 11 wherein the projections anchor the barrier in the poured concrete.

20. The method of claim 11 wherein the projections are arranged in spaced pairs, with each pair being V-shaped.

* * * * *